US005498128A

United States Patent [19]

Baets et al.

[11] Patent Number: 5,498,128

[45] Date of Patent: Mar. 12, 1996

[54] RADIAL-FLOW EXHAUST GAS TURBOCHARGER TURBINE WITH ADJUSTABLE GUIDE VANES

[75] Inventors: Jozef Baets, Baden; Marcel Zehnder, Niederwil, both of Switzerland

[73] Assignee: ABB Management AG, Baden, Switzerland

[21] Appl. No.: 212,823

[22] Filed: Mar. 15, 1994

[30] Foreign Application Priority Data

Mar. 25, 1993 [DE] Germany ..... 43 09 637.9

[51] Int. Cl.[6] ..... F01D 7/00

[52] U.S. Cl. ..... 415/164; 415/156; 415/160

[58] Field of Search ..... 415/156, 160, 415/163, 164

[56] References Cited

U.S. PATENT DOCUMENTS

| | | | |
|---|---|---|---|
| 537,494 | 4/1895 | Stevens et al. | 415/164 |
| 3,069,070 | 12/1962 | Macaluso et al. | 415/164 |
| 3,652,177 | 3/1972 | Loebel | 415/156 |
| 4,836,747 | 6/1989 | Hotz . | |

FOREIGN PATENT DOCUMENTS

| | | | |
|---|---|---|---|
| 0226444 | 6/1987 | European Pat. Off. . | |
| 0227475 | 7/1987 | European Pat. Off. . | |
| 0247905 | 12/1987 | European Pat. Off. . | |
| 0378343 | 7/1990 | European Pat. Off. . | |
| 0125186 | 5/1901 | Germany | 415/163 |
| 2260552 | 10/1977 | Germany . | |
| 0138397 | 5/1930 | Switzerland | 415/164 |
| 0360074 | 3/1962 | Switzerland | 415/160 |
| 0578034 | 3/1945 | United Kingdom | 415/163 |
| 0820595 | 9/1959 | United Kingdom | 415/163 |

OTHER PUBLICATIONS

"Controller for Variable Guide Vane in Supercharger and Like", Patent Abstracts of Japan, M–456 Feb. 25, 1986, vol. 10, No. 47, Patent No. 60–198306 date Jul. 10, 1985.

*Primary Examiner*—Edward K. Look
*Assistant Examiner*—Mark Sgantzos
*Attorney, Agent, or Firm*—Burns, Doane, Swecker & Mathis

[57] ABSTRACT

In a radial-flow exhaust turbocharger turbine with a row of individually adjustable guide vanes (18), said guide vanes can be turned by means of an adjusting shaft (19) supported in a casing (14). Each adjusting shaft (19) is actuated by means of a pivoting lever (21).

In each case two adjacent pivoting levers (21) are coupled by means of a connecting element (24). The connecting elements have a pivot (25) at their point of attachment to the pivoting lever. The distance (A) between the pivots (25) of a connecting element corresponds to the center distance (B) between two adjacent adjusting shafts (19). As a result, all the pivoting levers perform the same angular movement.

7 Claims, 3 Drawing Sheets

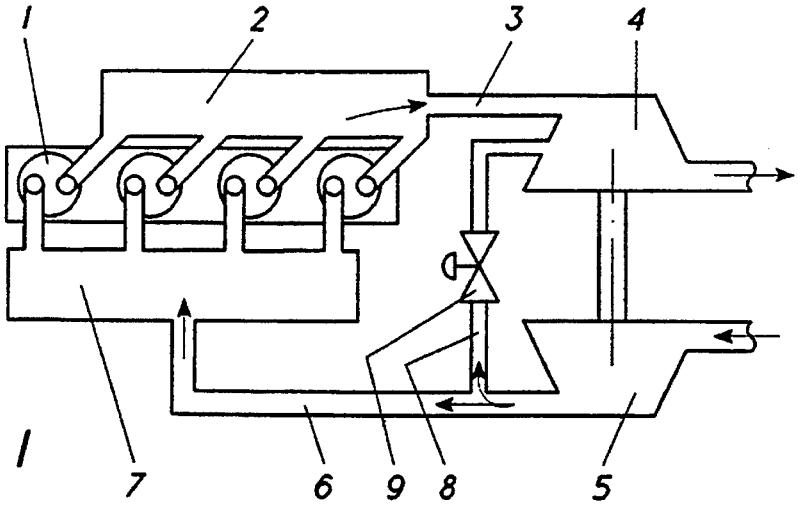
FIG. 1
FIG. 2
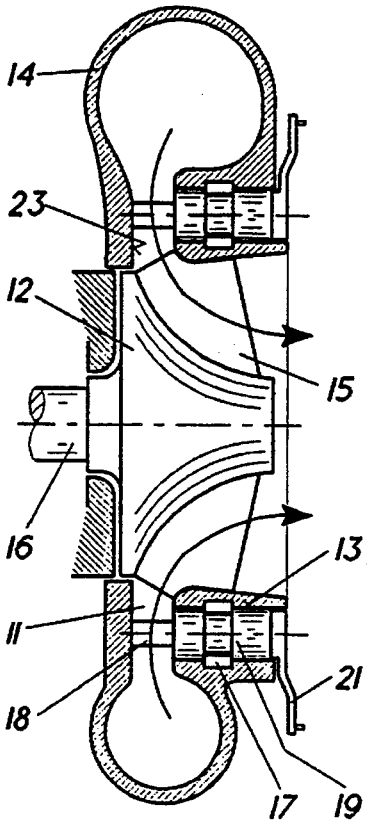
FIG. 3
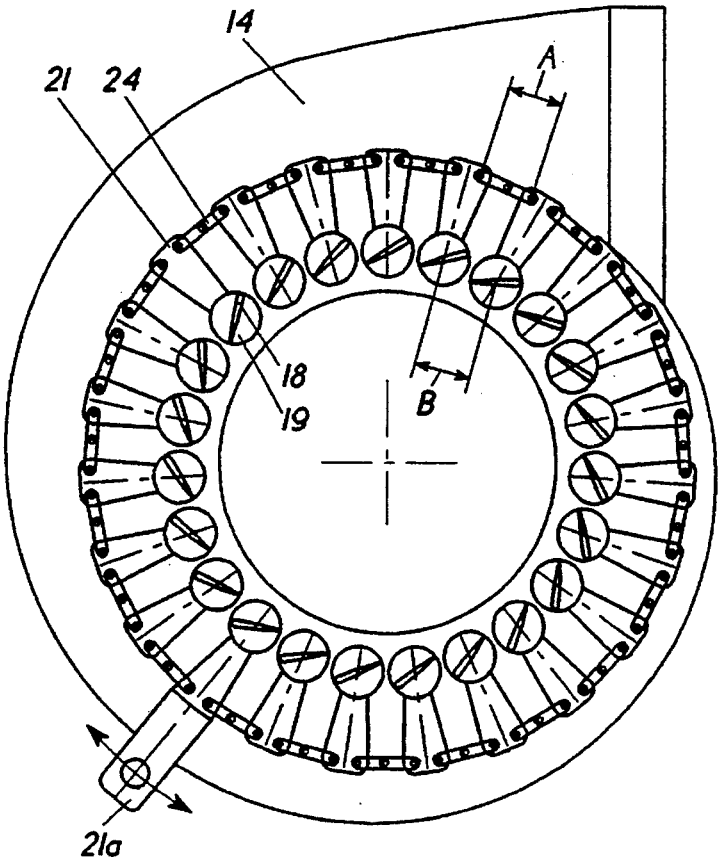

FIG. 5
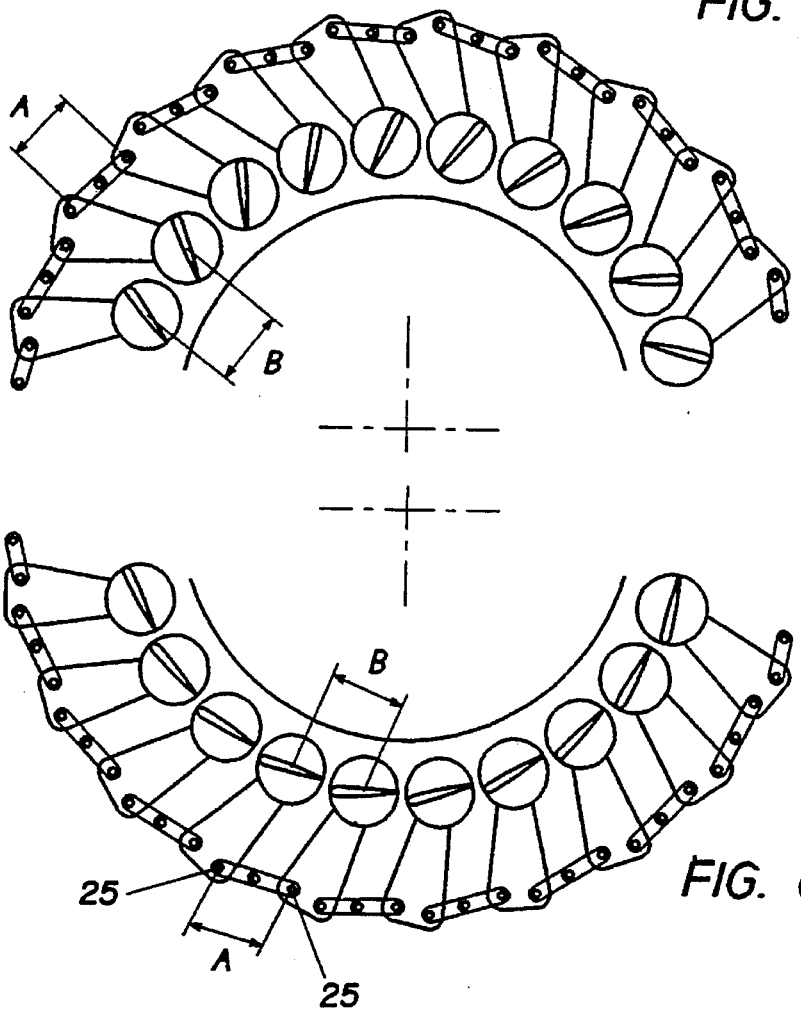
FIG. 6
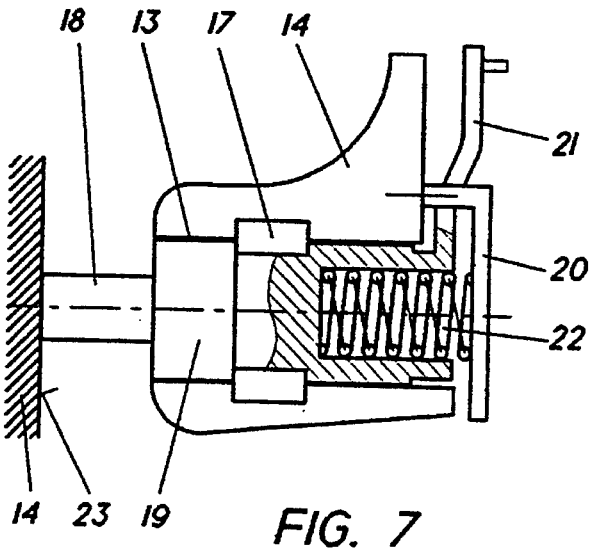
FIG. 7
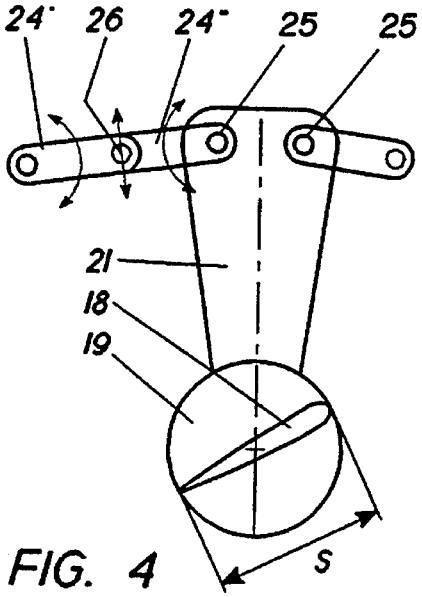
FIG. 4

RADIAL-FLOW EXHAUST GAS TURBOCHARGER TURBINE WITH ADJUSTABLE GUIDE VANES

BACKGROUND OF THE INVENTION

1. Field of the Invention

The invention relates to a radial-flow exhaust turbocharger turbine with a row of individually adjustable guide vanes which can be turned by means of respective adjusting shafts supported in a casing, each adjusting shaft being actuated by means of a pivoting lever.

2. Discussion of Background

Turbines of this kind are sufficiently well known in exhaust turbochargers. Adjustment of the guide vanes at the turbine is a possible measure as a control intervention to improve the acceleration and the torque behavior. Examples of this are provided by EP 226 444 B1 or EP 227 475 B1. The adjustable turbine guide vanes are intended to produce a larger gradient for a given throughput. This increases the turbine power, the turbine rotational speed and, finally, the boost pressure. In order to prevent the adjustable vanes from jamming during "hot" operation, they must, generally speaking, be installed with appropriate clearance. Particularly in the closed-down condition, the flow through the gaps at the tip and the root of the vanes can have a very disturbing effect on the main flow in the duct. In the machine according to EP 226 444 B1, this situation is remedied by designing the duct wall of the casing to be axially displaceable next to the turnable blade and pressing it against the adjustable vanes during operation.

In general, as can be seen from EP 226 444 B1 or EP 227 475 B1, the pivoting levers are driven by a common grooved ring. This grooved ring is rotatable and must therefore be bearing-mounted.

SUMMARY OF THE INVENTION

The object on which the invention is based is to simplify the adjusting mechanism in radial-flow turbines of the type stated at the outset.

According to the invention, this is achieved by virtue of the fact that in each case two adjacent pivoting levers are coupled by means of a connecting element, the connecting elements having a pivot at their point of attachment to the pivoting lever, and the distance A between the pivots of a connecting element corresponding to the center to center distance B between two adjacent adjusting shafts.

The advantage of the invention is to be seen particularly in the fact that a synchronous pivoting movement and an identical angular movement of all the levers is in this way guaranteed by the simplest means. Costly machining of and support for the hitherto customary grooved ring can be dispensed with.

It is expedient if the connecting elements are of two-part design and are provided with a third pivot joint. Connecting elements of this kind can compensate for different thermal expansions during operation and for any inaccuracies in production and installation.

If each adjusting shaft is provided with two axially adjacent bearing locations, it is expedient to provide an annular space which can be supplied with compressed air in the casing between the bearing locations. It is thereby possible, on the one hand, to cool the adjusting shaft and, on the other hand, to prevent working medium from escaping from the flow duct to the outside via the bearing locations.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, which show a single-stage exhaust turbocharger turbine with a radial turbine inlet and wherein:

FIG. 1 shows, schematically, a 4-cylinder internal combustion engine pressure-charged by means of an exhaust turbocharger;

FIG. 2 shows a partial longitudinal section through the turbine;

FIG. 3 shows a front view of the turning mechanism;

FIG. 4 shows a detail view of a pivoting lever with connecting links;

FIG. 5 shows a partial view of the turning mechanism with the guide vane cascade fully open;

FIG. 6 shows a partial view of the turning mechanism with the guide vane cascade fully closed;

FIG. 7 shows a partial section through the bearing arrangement for an adjusting shaft; and, FIG. 8 shows a partial view of a variant embodiment of the adjusting mechanism.

Figure 8:
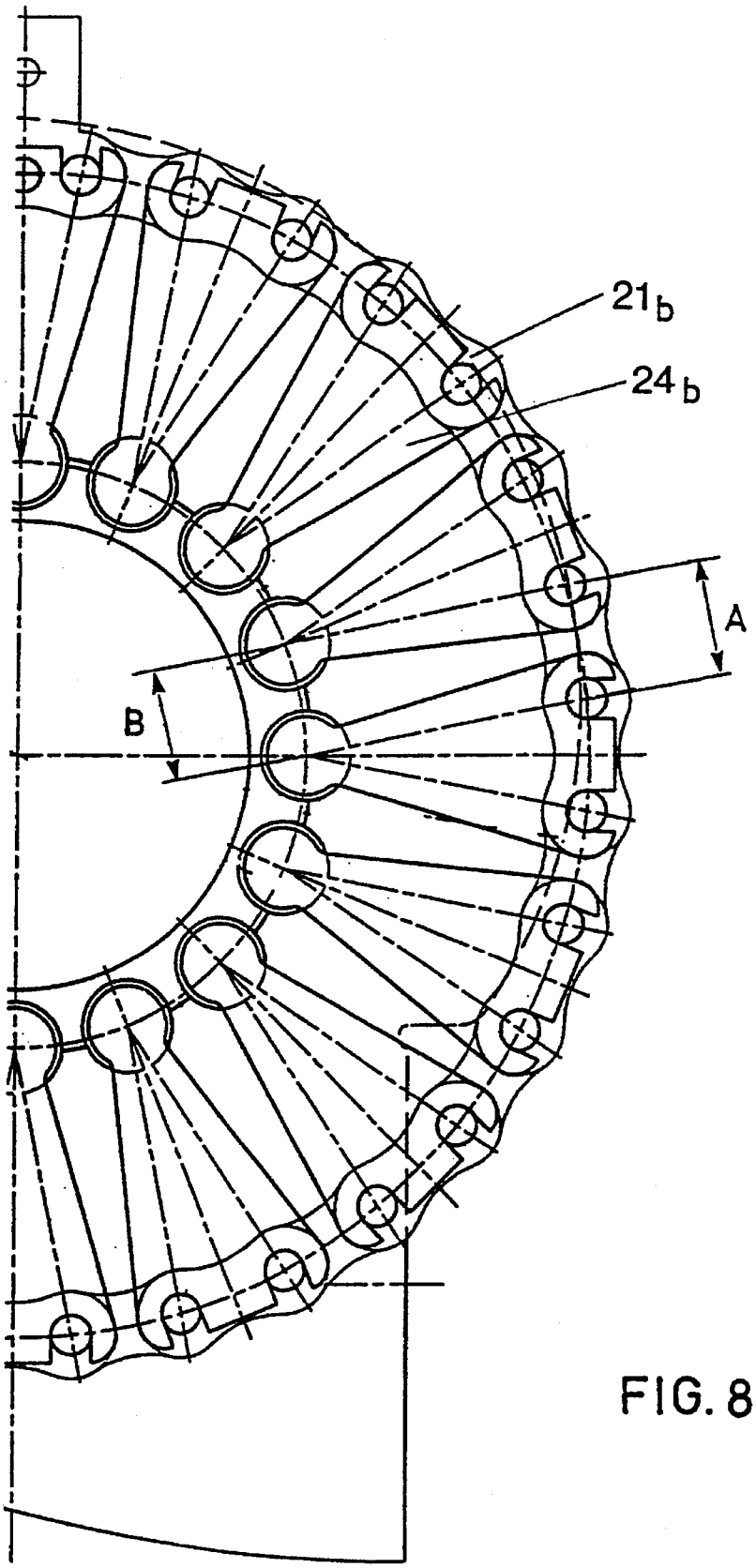

Only those elements which are essential for the understanding of the invention are shown. The casings with the inlet and outlet lines, the rotor together with its bearing arrangement etc. are not shown in FIG. 1, for example. The direction of flow of the working media is indicated by arrows.

DESCRIPTION OF THE PREFERRED EMBODIMENTS

Referring now to the drawings, wherein like reference numerals designate identical or corresponding parts throughout the several views, the internal combustion engine shown in FIG. 1 may be assumed to be a diesel engine. The exhaust gases from the individual cylinders flow into an exhaust manifold 2, in which the pressure surges are evened out. The exhaust gases pass at a virtually constant pressure, via the exhaust pipe 3, into the turbine 4, which operates by the pressure build-up method. The compressor 5 driven by the turbine delivers the air, induced at atmospheric pressure and compressed, via a charge-air line 6 to a charge-air manifold 7, from which the charge air passes into the individual cylinders. The turbine is provided with a variable equivalent cross-section in the form of adjustable guide vanes 18 (FIG. 2).

The gas turbine shown in part in FIG. 2 has radial inflow from a spiral to the blading and axial outflow from the blading. The walls bounding the duct 11 through which the air flows upstream of the rotor blades 15 are the inner left-hand and right-hand walls of the casing 14. In the region of the rotor blades 15, the duct 11 is bounded on the inside by the hub 12 of the rotor 16 fitted with rotor blades and, on the outside by the approximately axially extending wall of the casing 14.

The adjustable guide vanes 18 are preferably of one-piece design with their respective adjusting shafts 19. The shaft 19 is supported in the casing 14 in a hole 13 which passes through the casing 14. At its end protruding from the hole, the shaft is provided with a pivoting lever 21. This lever is of one-piece design with the adjusting shaft 19 and the guide vane 18 and may take the form of a casting, for example.

To cool the adjusting shafts 19, provision is made for compressed air to flow around them. To make available the air required, it is possible, for example, in accordance with FIG. 1, for a bypass line 8 with a regulating element 9 arranged therein to be provided upstream of the compressor. This bypass line 8 opens into the casing of the gas turbine 4. Each adjusting shaft 19 is provided with two axially adjacent bearing locations. Arranged between the bearing locations, in the bearing holes 13 of the casing, is an annular space 17 into which the compressed air is introduced. While exercising its cooling and sealing function, the compressed air flows around the bearing locations of the adjusting shaft and, via the bearing gaps, passes into the gas stream, on the one hand, and into the atmosphere, on the other.

As can be seen from FIG. 2 and, especially, FIG. 4, the chord S of each guide vane 18 is not greater than the largest diameter of the associated adjusting shaft 19. As viewed in the axial direction, the vane profile lies completely within the radially outermost contour of the associated adjusting shaft. It is thus possible to remove the unit comprising the vane and adjusting shaft from the bearing hole.

In order to avoid vane clearances at the free tip end of the guide vanes 18, each adjustable unit is designed to be axially displaceable in the bearing hole. As can be seen from FIG. 7, the adjusting shafts 19 are designed as hollow shafts. Spring means, here a helical spring 22, are situated in the hollow space. These spring means are supported against a ring 20, which is secured on the casing 14 in a suitable manner. The guide vane tip is pressed against the opposing duct wall 23 of the casing by these spring means.

The actual adjustment of the guide vanes 18 in the cascade is accomplished by means of the pivoting levers 21. In each case two adjacent pivoting levers 21 are coupled by a connecting element in order to ensure that the levers pivot synchronously. In FIGS. 2 to 6, the connecting elements are flat links 24 with pins. The pins engage in corresponding holes in the pivoting levers. At the point where they are attached to the pivoting lever 21, they form a pivot 25, as illustrated in FIGS. 4 and 5. To ensure that all the pivoting levers execute the same angular motion, the distance A between the pivots 25 of a connecting element must correspond to the center distance B between two adjacent adjusting shafts 19.

In the case of the example, the links are of two-part design. At their point of connection, the two parts 24' and 24" are provided with a third pivot joint 26. Connecting elements of this kind can compensate for manufacturing and installation inaccuracies and differing thermal expansions, as illustrated in FIG. 4.

The angular adjustment of the levers is accomplished by means of actuating means which are not shown, e.g. those known from the construction of compressors. As can be seen from FIG. 3, it is, for example, possible for this purpose for a piston to engage on an extended adjusting lever 21*a*. Adjustment is preferably accomplished automatically as a function of the operating parameters, such as the boost pressure, the rotational speed etc.

FIG. 5 shows a partial elevation in which the cascade is shown in the fully open position. The non-radial position of the vane inlet edges is of no significance here since the air flows into the cascade from a spiral at the correct angle anyway.

FIG. 6 shows a partial elevation in which the cascade is shown in the fully closed position, which corresponds to the smallest part load at which the turbine is to operate.

FIG. 8 shows a variant embodiment in which the connecting elements are chain links 24*b* of a roller chain. The pins forming the chain joint are the pivots 25 of the connecting element and the pivoting levers 21*b* are designed as a chain wheel.

Obviously, numerous modifications and variations of the present invention are possible in light of the above teachings. It is therefore to be understood that within the scope of the appended claims, the invention may be practiced otherwise than as specifically described herein.

What is claimed:

1. In a radial-flow exhaust gas turbocharger turbine:

a row of individually adjustable guide vanes disposed in a flow duct of the turbine;

a plurality of rotatable adjusting shafts supported in a casing, each guide vane mounted on an adjusting shaft, wherein a chord of each guide vane is not greater than a largest diameter of an associated adjusting shaft, and, when viewed in the axial direction, a vane profile of each guide vane lies completely within a radially outer contour of the associated adjusting shaft;

a like plurality of pivoting levers, each attached to an adjusting shaft to actuate rotation thereof;

a plurality of connecting elements, each connected to two adjacent pivoting levers to couple said adjacent pivoting levers, the connecting elements each having a pivot at a point of attachment to each pivoting lever, and a distance between the pivots of each connecting element being substantially equal to a center to center distance between two adjacent adjusting shafts;

wherein each guide vane, associated adjusting shaft and pivoting lever forms an adjustable unit of one-piece design that is removable from the turbine as a unit and each adjustable unit is axially displaceable and spring means to bias each unit against a duct wall of the casing.

2. The exhaust gas turbocharger turbine as claimed in claim 1, wherein the connecting elements are flat links with pins, the pins engaging in corresponding holes in the pivoting levers.

3. The exhaust gas turbocharger turbine as claimed in claim 2, wherein each link comprises two segments connected by a third pivot joint.

4. The exhaust gas turbocharger turbine as claimed in claim 1, wherein the connecting elements are chain links of a roller chain, the pins which form the chain joint forming the pivots of the connecting element and the pivoting levers being designed as a chain wheel.

5. The exhaust gas turbocharger turbine as claimed in claim 1, wherein each adjusting shaft is provided with two axially adjacent bearing locations between which is provided an annular space supplied with compressed air.

6. The exhaust gas turbocharger turbine as claimed in claim 1, wherein each pivoting lever is attached at a first end to a shaft and is connected to the connecting elements at a second end radially outward from the first end.

7. The exhaust gas turbocharger turbine as claimed in claim 1, wherein each pivoting lever is connected to two connecting elements at two individual pivot points.

* * * * *